US011098907B1

(12) United States Patent
Bruner et al.

(10) Patent No.: US 11,098,907 B1
(45) Date of Patent: Aug. 24, 2021

(54) APPARATUS AND METHOD FOR CONTAINING AND RECOVERING RESIDUE FROM A KITCHEN VENTILATION SYSTEM

(71) Applicant: Grease Catcher Systems, LLC, Knoxville, TN (US)

(72) Inventors: Gordon Bruner, Knoxville, TN (US); Kelly Otto, Middleboro, MA (US)

(73) Assignee: Grease Catcher Systems, LLC, Knoxville, TN (US)

( * ) Notice: Subject to any disclaimer, the term of this patent is extended or adjusted under 35 U.S.C. 154(b) by 216 days.

(21) Appl. No.: 16/414,834

(22) Filed: May 17, 2019

(51) Int. Cl.
*F24C 15/20* (2006.01)
*B08B 3/10* (2006.01)

(52) U.S. Cl.
CPC ..... *F24C 15/2042* (2013.01); *B08B 3/10* (2013.01); *F24F 2221/22* (2013.01)

(58) Field of Classification Search
CPC ... F24C 15/20; F24C 15/2042; F24F 2221/22; B08B 3/10
See application file for complete search history.

(56) References Cited

U.S. PATENT DOCUMENTS

| | | | | |
|---|---|---|---|---|
| 8,915,982 | B2 | 12/2014 | Haefele et al. | |
| 9,259,769 | B1 * | 2/2016 | Kane | F28G 9/00 |
| 9,574,779 | B2 | 2/2017 | Ritzer et al. | |
| 10,144,628 | B1 * | 12/2018 | Hardy | B65D 33/14 |
| 10,890,354 | B1 * | 1/2021 | Kane | B65D 33/00 |
| 10,982,915 | B2 * | 4/2021 | Hui | F28G 15/00 |
| 2016/0114360 | A1 | 4/2016 | McMenamin | |
| 2017/0144201 | A1 | 5/2017 | Ritzer et al. | |

FOREIGN PATENT DOCUMENTS

| | | |
|---|---|---|
| DE | 3024119 | 6/1980 |
| DE | 3030452 | 8/1980 |
| EP | 3018420 | 5/2016 |
| EP | 2333446 | 8/2017 |
| FR | 3006613 | 5/2016 |

OTHER PUBLICATIONS

Information regarding the Teinnova Tegras System found at https://teinnovacleaning.com/grease-ductwork-cleaning-tegras/.

* cited by examiner

*Primary Examiner* — David J Laux
*Assistant Examiner* — Nikhil P Mashruwala
(74) *Attorney, Agent, or Firm* — Robinson IP Law, PLLC

(57) ABSTRACT

A containment apparatus, kit and method for containing liquid waste when cleaning a kitchen ventilation system wherein the containment apparatus includes a funnel that is removably attachable to an attachment device on a kitchen ventilation hood.

11 Claims, 7 Drawing Sheets

APPARATUS AND METHOD FOR CONTAINING AND RECOVERING RESIDUE FROM A KITCHEN VENTILATION SYSTEM

FIELD

This disclosure relates to the field of kitchen maintenance. More particularly, this disclosure relates to apparatuses and methods for cleaning kitchen ventilation systems.

BACKGROUND

Most large or industrial-sized kitchens include a kitchen ventilation system (also referred to as kitchen exhaust system or kitchen extraction system) for venting out kitchen heat and exhaust that occurs when food is cooked on a cooking surface. As these systems are used, grease and other residue builds up inside the ducts, hoods, fans and vents used to draw heat and cooking exhaust from a kitchen. In order to clean such structures, water and/or other cleaning compositions are often sprayed or otherwise applied on various internal structures of a kitchen ventilation system. In some cases, a plastic liner is used to divert liquid waste from internal structures to a disposal container in the kitchen. "Liquid waste" is broadly defined herein as any material, whether solids, liquids, gases or combinations thereof, that accumulate during the washing of the internal structures of a kitchen ventilation system. However, attaching such a plastic liner to an overhead kitchen ventilation hood is often difficult and, in the process, can cause damage to the kitchen ventilation hood and still often results in a significant mess in the kitchen after flushing of the internal structures of the kitchen ventilation system is concluded. For example, it is often necessary to cut into fire caulk when attaching a plastic liner to a ventilation hood, thereby creating a fire safety risk by weakening fire-stopping systems. When liners are not used, there is a significant mess throughout the kitchen from the liquid waste that is flushed through the kitchen ventilation system.

What is needed, therefore, is an apparatus and method for diverting liquid waste to a disposal container when cleaning a kitchen ventilation system to provide a reliable way to minimize mess and limit damage to the ventilation hood of the kitchen ventilation system being cleaned.

SUMMARY

The above and other needs are met by a containment apparatus for containing liquid waste when cleaning a kitchen ventilation system, the containment apparatus comprising (a) an attachment device attached to a ventilation hood of a kitchen ventilation system; (b) a funnel including a funnel base wherein the funnel is removably attached to the attachment device; and (c) a drain line attached to the funnel base. In preferred embodiments, the attachment device is permanently attached to the ventilation hood.

In some embodiments the attachment device may further include a plurality of panels wherein each panel comprises at least one hook extending out therefrom, thereby providing a plurality of hooks; and the funnel may further include a plurality of funnel apertures along an upper edge of the funnel wherein the spacing of the funnel apertures corresponds to the spacing of the plurality of hooks and wherein the funnel is removably attached to the attachment device by insertion of the plurality of hooks into the plurality of funnel apertures so that the funnel hangs on the attachment device.

In some embodiments the funnel may further include a first side in the shape of a triangle including a first upper edge including some of the apertures of the plurality of funnel apertures; a second side in the shape of a triangle including a second upper edge including some of the apertures of the plurality of funnel apertures; a third side in the shape of a triangle including a third upper edge including some of the apertures of the plurality of funnel apertures; and a fourth side in the shape of a triangle including a fourth upper edge including some of the apertures of the plurality of funnel apertures.

Additionally or alternatively, the funnel may further include a funnel base and a coupling pipe attached to the funnel base wherein liquid waste can be funneled to the coupling pipe; and the drain line may further include a hose including a first end attached to the coupling pipe wherein liquid waste can travel from the coupling pipe through the hose.

Additionally or alternatively, the attachment device may further include a first hook and loop fastener strip; and the funnel may further include a second hook and loop fastener strip attached along an upper edge of the funnel wherein the first hook and loop fasteners strip is removably attached to the second hook and loop fastener strip so that the funnel hangs on the attachment device.

In another aspect, embodiments of the disclosure provide a kit for installing a containment apparatus for containing liquid waste when cleaning a kitchen ventilation system. The kit comprises (a) an attachment device for permanent attachment to a ventilation hood of a kitchen ventilation system; (b) a funnel for attachment to the attachment device, the funnel comprising a funnel base where liquid waste flows when cleaning a kitchen ventilation system; and (c) a drain line for attachment to the base of the funnel wherein liquid waste flows from the funnel, through the funnel base, and through the drain line when cleaning a kitchen ventilation system.

In the kit described above, the attachment device may further include a plurality of panels wherein each panel comprises at least one hook extending out therefrom, thereby providing a plurality of hooks; and the funnel may further include a plurality of funnel apertures along an upper edge of the funnel wherein the spacing of the funnel apertures corresponds to the spacing of the plurality of hooks when the funnel is attached to the attachment device and wherein the funnel is removably attachable to the attachment device by insertion of the plurality of hooks into the plurality of funnel apertures so that the funnel hangs on the attachment device.

In some embodiments of the kit, the funnel may further include a first side in the shape of a triangle including a first upper edge including some of the apertures of the plurality of funnel apertures; a second side in the shape of a triangle including a second upper edge including some of the apertures of the plurality of funnel apertures; a third side in the shape of a triangle including a third upper edge including some of the apertures of the plurality of funnel apertures; and a fourth side in the shape of a triangle including a fourth upper edge including some of the apertures of the plurality of funnel apertures.

Additionally or alternatively, the funnel in the kit may further include a funnel base and a coupling pipe attached to the funnel base wherein liquid waste can be funneled to the coupling pipe; and the drain line may further include a hose including a first end attachable to the coupling pipe wherein liquid waste can travel from the coupling pipe through the hose when cleaning a kitchen ventilation system.

Additionally or alternatively, the attachment device in the kit may further include a first hook and loop fastener strip; and the funnel may further include a second hook and loop fastener strip attached along an upper edge of the funnel wherein the first hook and loop fasteners strip is removably attachable to the second hook and loop fastener strip so that the funnel will hang on the attachment device.

In another aspect, embodiments of the disclosure provide a method for cleaning a kitchen ventilation system, the method comprising the steps of attaching an attachment device to a ventilation hood; attaching a funnel to the attachment device temporarily; attaching a drain line to the funnel; and washing internal components of a kitchen ventilation system wherein liquid waste from the washing activity passes through the funnel and then through the drain line to a disposal point. Preferably, the attachment device is attached to the ventilation hood permanently.

The summary provided herein is intended to provide examples of particular disclosed embodiments and is not intended to cover all potential embodiments or combinations of embodiments. Therefore, this summary is not intended to limit the scope of the invention disclosure in any way, a function which is reserved for the appended claims.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

The figures are provided to illustrate concepts of the invention disclosure and are not intended to embody all potential embodiments of the invention. Therefore, the figures are not intended to limit the scope of the invention disclosure in any way, a function which is reserved for the appended claims.

DETAILED DESCRIPTION

Figure 1:
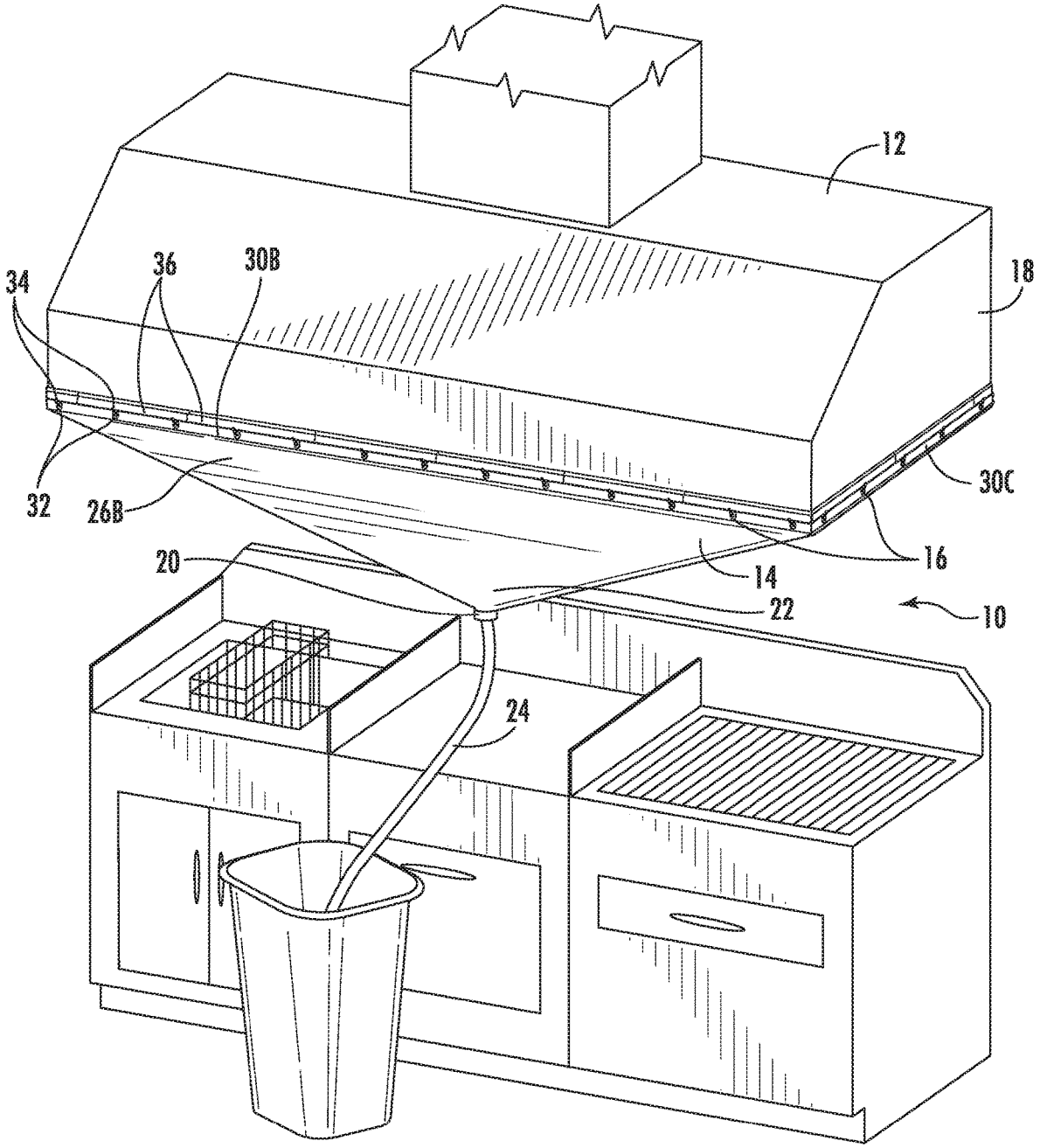
FIG. 1 shows a perspective view of an embodiment of a cleaning and containment apparatus for use when cleaning a kitchen ventilation system.
Figure 2:
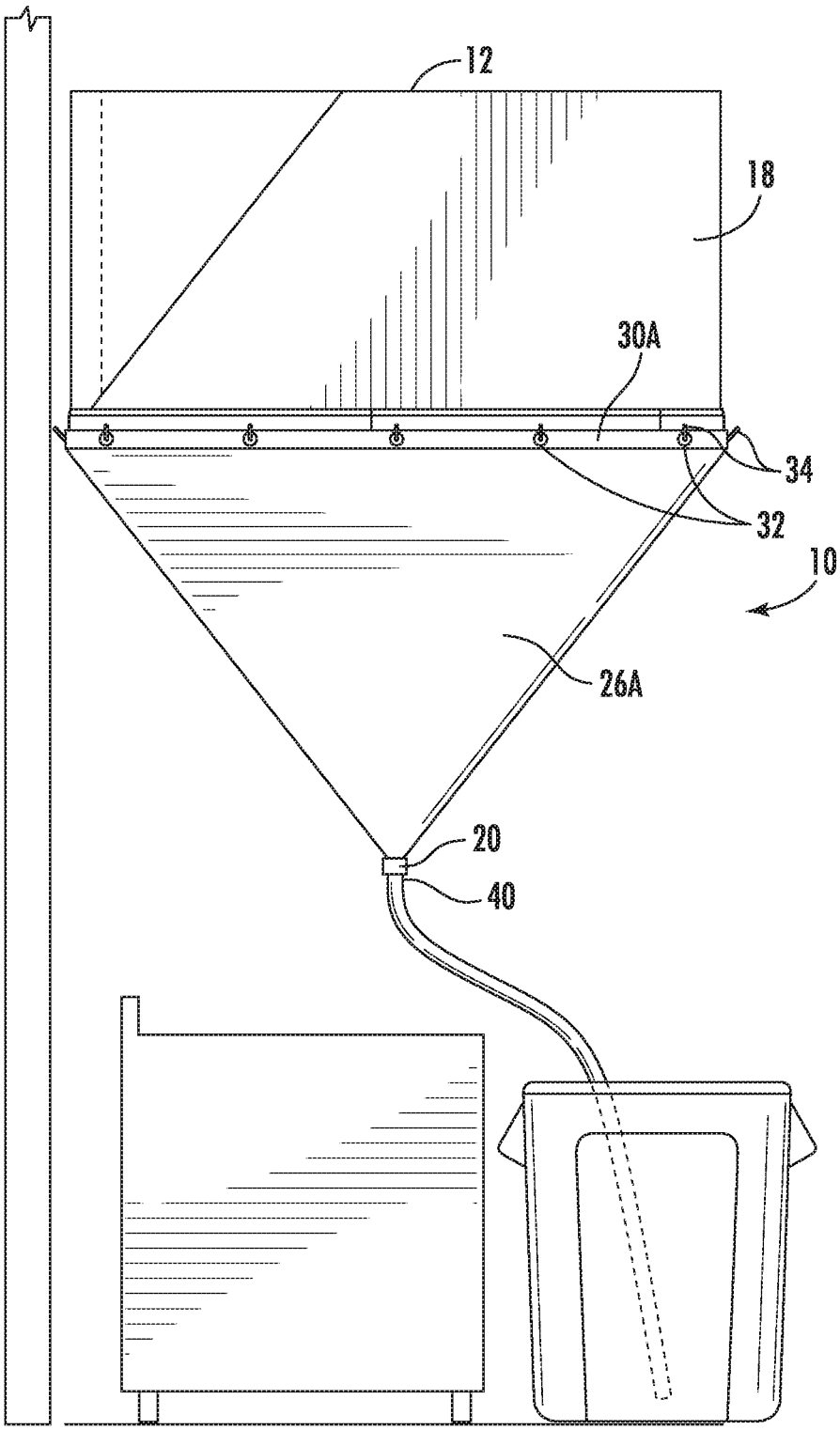
FIG. 2 shows an end view of the embodiment of the cleaning and containment apparatus shown in FIG. 1.

FIG. 1 and FIG. 2 show an embodiment of a containment apparatus 10 for use when cleaning a kitchen ventilation system 12. The containment apparatus 10 includes a funnel 14, an attachment device 16 for removably attaching the funnel 14 to a ventilation hood 18, a coupling pipe 20 attached to and at the base 22 of the funnel 14, and a drain line 24 attached to the coupling pipe 20. In some embodiments, the drain line 24 is attached directly to the base 22 of the funnel 14 without the use of a coupling pipe 20. The attachment device 16 is preferably permanently attached along a perimeter of a ventilation hood. "Permanently" as used throughout this specification including the summary section and the claims does not mean that the attachment device 16 cannot be detached from a ventilation hood; rather, the term "permanently" is intended to connote long-term attachment measured in months or years as opposed to a few hours or a few days. Such attachment may be accomplished by using various materials such as, for example, screws, bolts, and/or one or more permanent adhesives.

Figure 3:
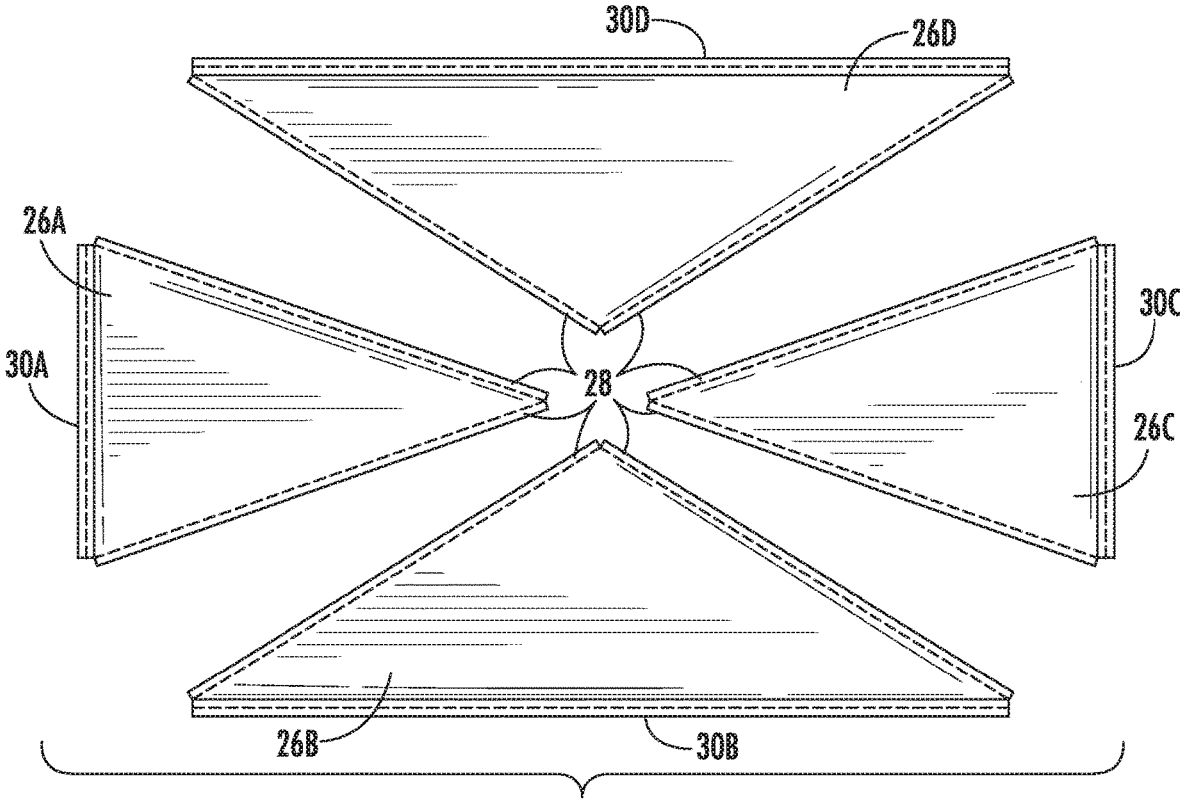
FIG. 3 shows an embodiment of four sides of a funnel wherein the four sides are shown separated.

FIG. 3 shows a preferred embodiment of sides 26 of the funnel 14 wherein each side (first side 26A, second side 26B, third side 26C and fourth side 26D) is preferably in a triangular shape with two smaller triangular sides (first side 26A and third side 26C) and two larger triangular sides (second side 26B and fourth side 26D). The sides 26 are preferably hot seam welded together along weld edges 28. The sides 26 are preferably made of plastic preferably having a thickness ranging from about 4 mils (0.1016 millimeters (mm)) to about 8 mils (0.2032 mm) and more preferably about 6 mils (0.1524 mm). The plastic preferably includes polyethylene and is preferably medium density polyethylene. However, other densities of polyethylene can be used and other polymeric materials other than polyethylene can be used.

Figure 4:
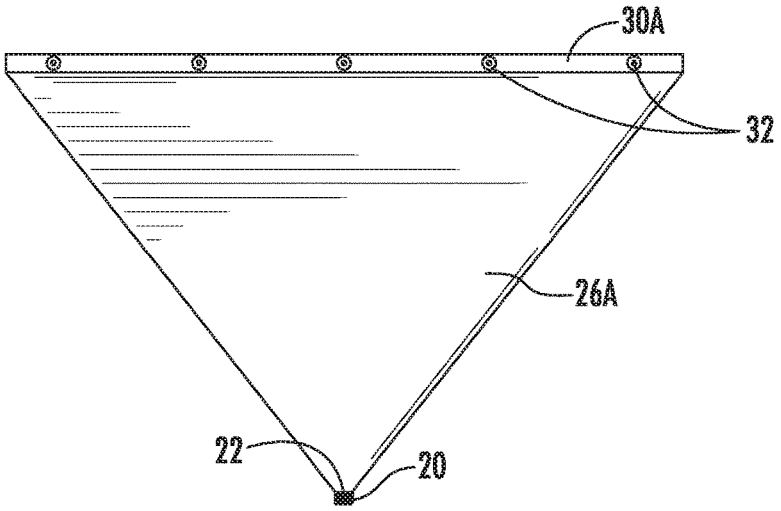
FIG. 4 shows a first side view of an embodiment of a funnel.
Figure 5:
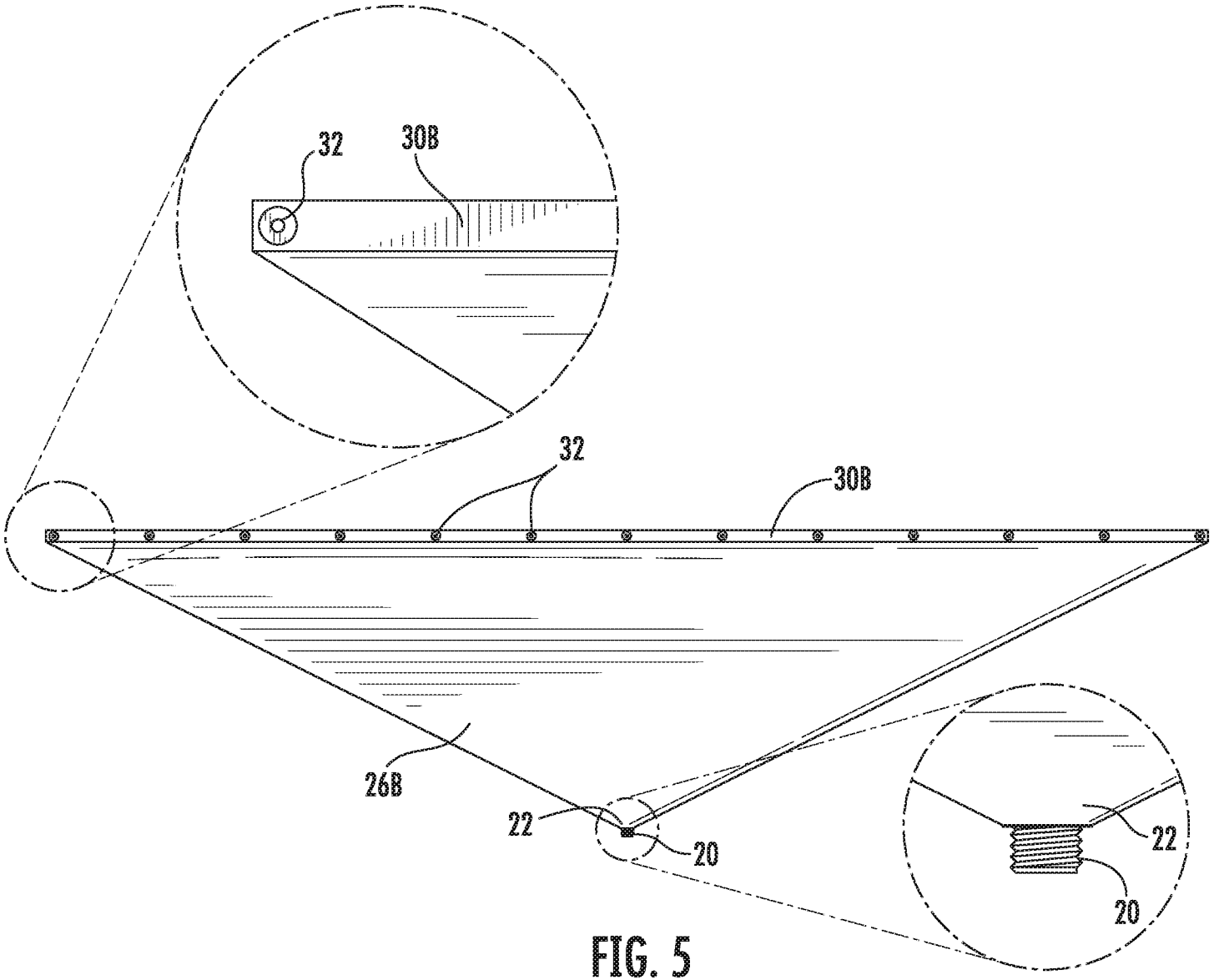
FIG. 5 shows a second side view of the funnel shown in FIG. 4 with a close-up view of an upper corner of the second side of the funnel and a close-up view of a threaded pipe end at the base of the funnel.

FIG. 4 shows an end view of the funnel 14 showing the first side 26A and the coupling pipe 20 which is preferably a short piece of polymeric pipe that is at least partially threaded on its outer surface. The coupling pipe 20 is preferably made of polyvinyl chloride (PVC) or other similar polymeric material and is preferably about 1.5 inches (38.1 mm) in diameter. The coupling pipe 20 is preferably welded to the base 22 of the funnel 14. A first upper edge 30A of the first side 26A is preferably reinforced and preferably includes a plurality of funnel apertures 32. The plurality of funnel apertures 32 are preferably reinforced with metal rings around the apertures 32. Each side preferably includes an upper edge with funnel apertures 32. The second side 26B includes a second upper edge 30B including some of the plurality of funnel apertures 32 and is shown for example in FIG. 5. The third side 26C includes a third upper edge 30C including some of the plurality of funnel apertures 32; and the fourth side 26D includes a fourth upper edge 30D including some of the plurality of funnel apertures 32. The spacing between the plurality of funnel apertures 32 corresponds with the spacing between a plurality of hooks 34 extending from the ventilation hood 18. Such spacing is preferably about 12 inches (about 30 centimeters (cm)), but different spacing lengths can be used. The attachment device 16 preferably includes the plurality of hooks 34 wherein the plurality of hooks 34 extend through the plurality of apertures 32 when the funnel 14 is removably attached to a ventilation hood so that the funnel 14 hangs on the attachment device 16. In a less preferred embodiment, hook and loop fastener strips may be used instead of the plurality of apertures 32 and plurality of hooks 34.

In a preferred embodiment, a plurality of panels 36 are attached to a ventilation hood such as the ventilation hood 18 shown in FIG. 1 and FIG. 2. Each of the plurality of panels 36 preferably includes one or more hooks (e.g., the plurality of hooks 34) attached thereto or otherwise extending therefrom. The plurality of panels 36 are preferably attached to a ventilation hood using screws or other similar attachment device which are preferably inserted through a plurality of panel apertures 38 in the plurality of panels 36. The panel apertures 38 are preferably spaced apart by about 12 inches (about 30 cm), but various spacing between panel apertures 38 can be used. As an alternative example, the plurality of panels 36 can be spot welded to a ventilation hood.

Figure 6A:
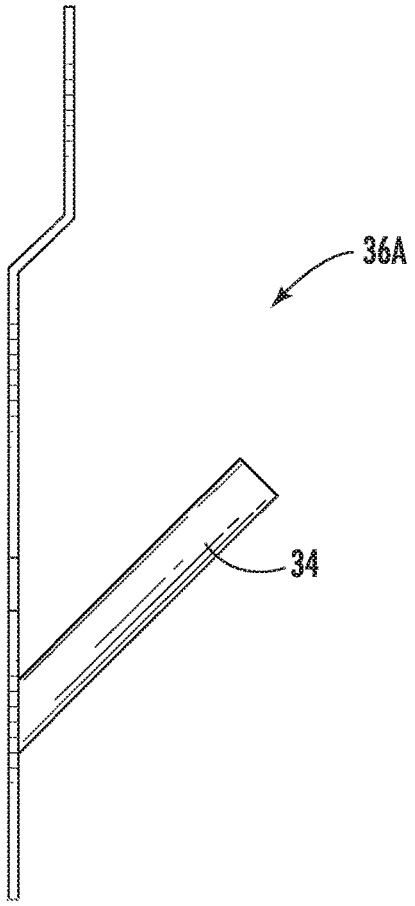
FIG. 6A shows an end view of an embodiment of a first panel including a plurality of hooks.
Figure 6B:
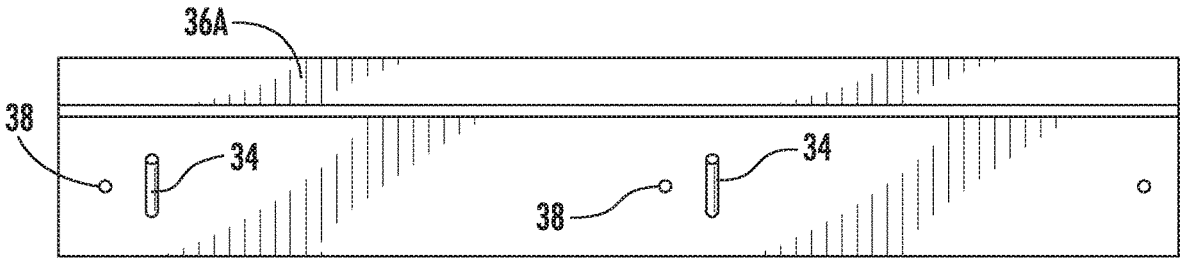
FIG. 6B shows a side view of the first panel shown in FIG. 6A.
Figure 7A:
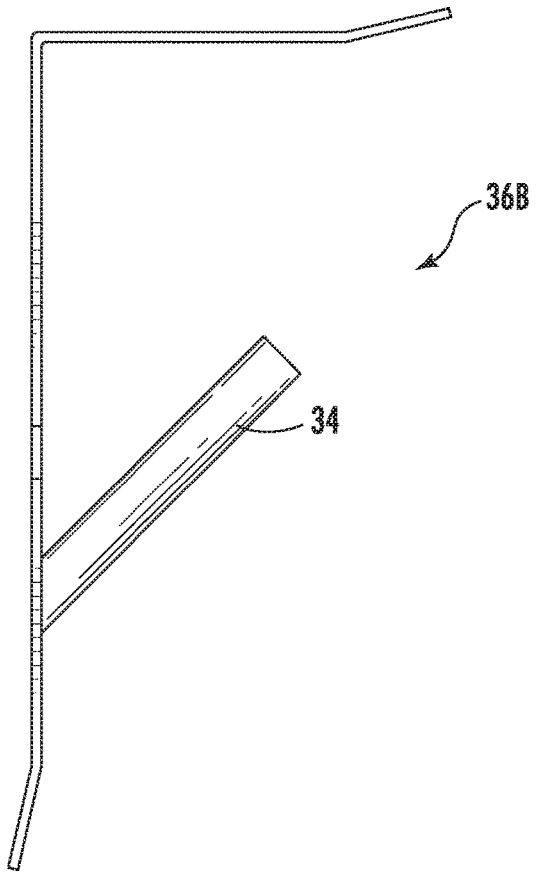
FIG. 7A shows an end view of an embodiment of a second panel including a plurality of hooks.
Figure 7B:
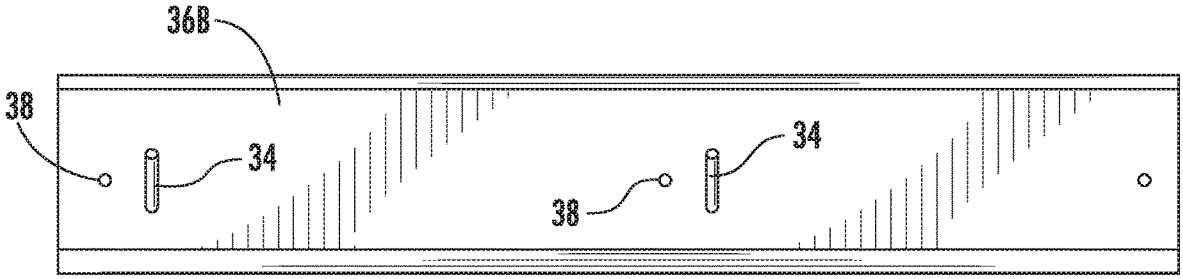
FIG. 7B shows a side view of the second panel shown in FIG. 7A.
Figure 8A:
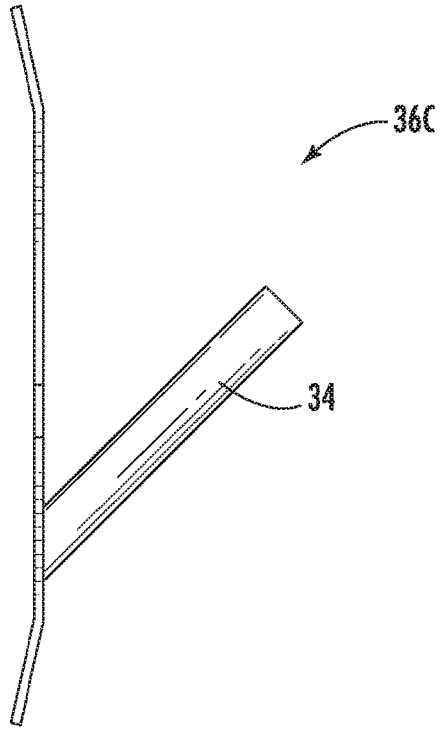
FIG. 8A shows an end view of an embodiment of a third panel including a plurality of hooks.
Figure 8B:
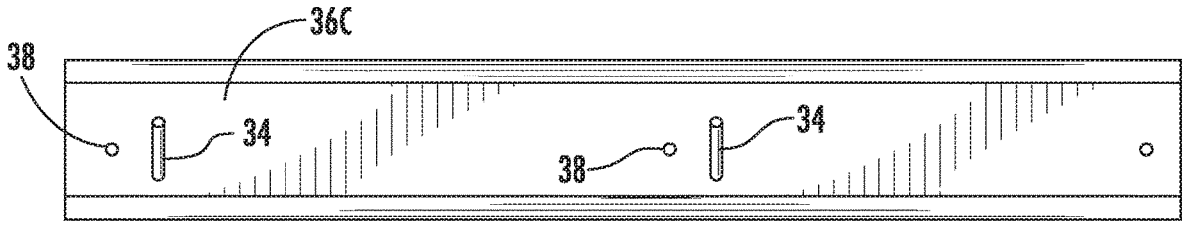
FIG. 8B shows a side view of the third panel shown in FIG. 8A.

FIG. 6A and FIG. 6B show one example of a first panel 36A contoured to fit a specifically-shaped ventilation hood. FIG. 7A and FIG. 7B show an example of a second panel 36B contoured to fit a different specifically-shaped ventilation hood. FIG. 8A and FIG. 8B show an example of a third panel 36C contoured to fit a different specifically-shaped ventilation hood. Although specifically-shaped panels are provided herein, this disclosure is not intended to be limited to a specific panel contour. Panels 36 with different contours can be used to fit different shaped ventilation hoods. Usually, panels 36 with the same or similar contour(s) are used together on a ventilation hood, although, in some cases, it may be necessary to use different contoured panels on the same ventilation hood. The example panels 36 provided herein are all shown as being a specific length with two hooks and two panel apertures, but this disclosure is not intended to be limited to these configurations. Different sized panels (e.g., with different lengths and widths) can be used having different numbers of hooks and panel apertures other than two. The plurality of panels 36 are preferably made of metal or metal alloy. If spot welding is the method of attaching the plurality of panels 36 to a ventilation hood, the plurality of panels 36 may not include panel apertures.

The drain line 24 preferably includes a hose including a threaded end 40 to attach to the coupling pipe 20. The drain line 24 can be different lengths depending on where a user desires to direct liquid waste during a cleaning procedure. The drain line 24 preferably terminates in a receptacle which can hold liquid without leaking such as, for example, a plastic bucket.

The size of the containment apparatus 10 can vary depending on the size of the ventilation hood on which the containment apparatus 10 is attached. The depth of the funnel 14 is preferably about 3 feet (about 92 cm), but the depth may vary somewhat and still function as intended.

A method for cleaning a kitchen ventilation system using the containment apparatus 10 preferably includes attaching an attachment device to a ventilation hood permanently; attaching a funnel to the attachment device temporarily; attaching a drain line to the funnel; and washing internal components of a kitchen ventilation system wherein liquid waste from the washing activity passes through the funnel and then through the drain line to a disposal point. A disposal point may include, for example, a plastic bucket or other similar container or a drain that leads to an on-site or off-site destination for liquid waste.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A containment apparatus for containing liquid waste when cleaning a kitchen ventilation system, the containment apparatus comprising:
   a. an attachment device permanently attached to a ventilation hood of a kitchen ventilation system, the attachment device comprising a plurality of panels wherein each panel comprises at least one hook extending out therefrom, thereby providing a plurality of hooks;
   b. a funnel including a funnel base wherein the funnel is removably attached to the attachment device; and
   c. a drain line attached to the funnel base.

2. The containment apparatus of claim 1 wherein:
   the funnel further comprises a plurality of funnel apertures along an upper edge of the funnel wherein the spacing of the funnel apertures corresponds to the spacing of the plurality of hooks and wherein the funnel is removably attached to the attachment device by insertion of the plurality of hooks into the plurality of funnel apertures so that the funnel hangs on the attachment device.

3. The containment apparatus of claim 2 wherein the funnel further comprises:
   a. a first side in the shape of a triangle including a first upper edge including some of the apertures of the plurality of funnel apertures;
   b. a second side in the shape of a triangle including a second upper edge including some of the apertures of the plurality of funnel apertures;
   c. a third side in the shape of a triangle including a third upper edge including some of the apertures of the plurality of funnel apertures; and
   d. a fourth side in the shape of a triangle including a fourth upper edge including some of the apertures of the plurality of funnel apertures.

4. The containment apparatus of claim 1 wherein:
   a. the funnel further comprises a funnel base and a coupling pipe attached to the funnel base wherein liquid waste can be funneled to the coupling pipe; and
   b. the drain line further comprises a hose including a first end attached to the coupling pipe wherein liquid waste can travel from the coupling pipe through the hose.

5. The containment apparatus of claim 1 wherein:
   a. the attachment device further comprises a first hook and loop fastener strip; and
   b. the funnel further comprises a second hook and loop fastener strip attached along an upper edge of the funnel wherein the first hook and loop fasteners strip is removably attached to the second hook and loop fastener strip so that the funnel hangs on the attachment device.

6. A kit for installing a containment apparatus for containing liquid waste when cleaning a kitchen ventilation system, the kit comprising:
   e. an attachment device for permanent attachment to a ventilation hood of a kitchen ventilation system, comprising a plurality of panels wherein each panel comprises at least one hook extending out therefrom, thereby providing a plurality of hooks;

f. a funnel for attachment to the attachment device, the funnel comprising a funnel base where liquid waste flows when cleaning a kitchen ventilation system; and g. a drain line for attachment to the base of the funnel wherein liquid waste flows from the funnel, through the funnel base, and through the drain line when cleaning a kitchen ventilation system.

7. The kit of claim 6 wherein:

the funnel further comprises a plurality of funnel apertures along an upper edge of the funnel wherein the spacing of the funnel apertures corresponds to the spacing of the plurality of hooks when the funnel is attached to the attachment device and wherein the funnel is removably attachable to the attachment device by insertion of the plurality of hooks into the plurality of funnel apertures so that the funnel hangs on the attachment device.

8. The kit of claim 7 wherein the funnel further comprises:

a. a first side in the shape of a triangle including a first upper edge including some of the apertures of the plurality of funnel apertures;

b. a second side in the shape of a triangle including a second upper edge including some of the apertures of the plurality of funnel apertures;

c. a third side in the shape of a triangle including a third upper edge including some of the apertures of the plurality of funnel apertures; and d. a fourth side in the shape of a triangle including a fourth upper edge including some of the apertures of the plurality of funnel apertures.

9. The kit of claim 7 wherein:

a. the funnel further comprises a funnel base and a coupling pipe attached to the funnel base wherein liquid waste can be funneled to the coupling pipe; and b. the drain line further comprises a hose including a first end attachable to the coupling pipe wherein liquid waste can travel from the coupling pipe through the hose when cleaning a kitchen ventilation system.

10. The kit of claim 7 wherein:

a. the attachment device further comprises a first hook and loop fastener strip; and b. the funnel further comprises a second hook and loop fastener strip attached along an upper edge of the funnel wherein the first hook and loop fasteners strip is removably attachable to the second hook and loop fastener strip so that the funnel will hang on the attachment device.

11. A method for cleaning a kitchen ventilation system, the method comprising:

i. attaching an attachment device permanently to a ventilation hood, the attachment device comprising a plurality of panels wherein each panel comprises at least one hook extending out therefrom, thereby providing a plurality of hooks;

j. attaching a funnel to the attachment device temporarily, the funnel comprising a funnel base wherein the funnel is removably attached to the attachment device;

k. attaching a drain line to the funnel; and l. washing internal components of a kitchen ventilation system wherein liquid waste from the washing activity passes through the funnel and then through the drain line to a disposal point.

* * * * *